United States Patent [19]

Schillinger et al.

[11] Patent Number: 4,876,960

[45] Date of Patent: Oct. 31, 1989

[54] FUSE FOR LOW-SPIN OR NON-SPIN PROJECTILES

[75] Inventors: Wolfgang Schillinger, Schiltach; Andreas Hälssig, Denkingen; Wolfgang Zehnder, Schramberg, all of Fed. Rep. of Germany

[73] Assignee: Gebrüder Junghans GmbH, Schramberg, Fed. Rep. of Germany

[21] Appl. No.: 280,359

[22] Filed: Dec. 6, 1988

[30] Foreign Application Priority Data

Dec. 16, 1987 [DE] Fed. Rep. of Germany ..... 3742575

[51] Int. Cl.[4] ..... F42C 9/04; F42C 15/18; F42C 15/24

[52] U.S. Cl. ..... 102/249; 102/251; 102/255

[58] Field of Search ..... 102/249, 251, 256, 248, 102/247, 252, 253, 254, 255

[56] References Cited

U.S. PATENT DOCUMENTS

| | | | |
|---|---|---|---|
| 2,164,115 | 6/1939 | Lasserre | 102/249 |
| 2,863,393 | 12/1958 | Sheeley | 102/249 |
| 2,882,826 | 4/1959 | Billings | 102/248 |
| 3,139,828 | 7/1964 | Delaney et al. | 102/248 |
| 3,170,404 | 2/1965 | Swaim et al. | 102/248 |
| 3,376,820 | 4/1968 | Gelman | 102/249 |
| 3,618,528 | 11/1971 | Muller | 102/249 |
| 4,128,061 | 12/1978 | Kaiser | 102/249 |
| 4,389,937 | 6/1983 | Golay et al. | 102/249 |

FOREIGN PATENT DOCUMENTS 3107110 3/1984 Fed. Rep. of Germany .

*Primary Examiner*—David H. Brown

*Attorney, Agent, or Firm*—Burns, Doane, Swecker & Mathis

[57] ABSTRACT

A fuse for low-spin or non-spin projectiles comprises a detonator-carrying rotor movable to a live position. The rotor is released for movement in response to firing recoil. Movement of the rotor is effected by a spring which is relaxed prior to recoil firing and is energized in response to firing recoil.

5 Claims, 1 Drawing Sheet

FUSE FOR LOW-SPIN OR NON-SPIN PROJECTILES

BACKGROUND AND OBJECT OF THE INVENTION

The invention concerns a fuse for low spin or non-spinning projectiles with a recoiling system for controlling a detonator carrier.

A fuse of the above-mentioned type is known from German Pat. No. 31 07 110 which discloses a safety device for a fuse of high-spin projectiles wherein a recoil bolt system is carried by the detonator-carrying rotor. Upon the firing of a projectile, a first recoil bolt carried by the rotor is moved rearwardly against the pressure of a spring. A ball normally resting against a cone of a second recoil bolt is cammed thereby against an opposing cone of the now-retracted first recoil bolt, whereupon rearward movement of the second recoil bolt is permitted in order to unlock the rotor. The spring at the first recoil bolt locks the recoil bolt system in the live position by jamming the ball between the cone of the first recoil bolt and a portion of the second recoil bolt. In response to the centrifugal forces generated by the high-speed spin of the projectile, the rotor is then caused to rotate to a live position.

In the case of a low-spin or non-spin projectile, however, centrifugal force cannot be relied upon for imparting movement to the rotor. Although a spring of some sort could be used to achieve that result, a spring which exerts a continuous bias (i.e., a constant potential energy) against the rotor would adversely affect the safety aspect of the fuse, since the fuse would be moved by the spring to a live position in response to being unlocked regardless of whether such unlocking was caused by a firing of the projectile or a malfunction of the locking mechanism.

Based on this state of the art, it is an object of the invention to satisfy the fundamental requirement of a fuse of this type, i.e., to avoid the use of potential energy.

SUMMARY OF THE INVENTION

This object is attained according to the invention which includes a spring operably connected to the detonator carrier (preferably a rotor) and disposed in a relaxed state prior to firing recoil. A spring-energizing recoil device is connected to the spring for energizing the spring to bias the detonator carrier toward the live position in response to the firing recoil. Preferably, the spring has two legs, the first leg of which, in the safety position, is abutting against the lower end of a cone of an axially movable recoil bolt, and the second leg whereof is engaging a pin or a recess in the circumferential surface of the detonator carrier.

Preferably, the spring is bent in the shape of a U around a bolt. The second leg of the spring is resting against a short radial wall of the recess. In response to the firing recoil, the rotor is released for rotation, and the spring is prestressed for turning the rotor to its live position. This satisfies, in an advantageously simple manner, the fundamental requirement of a fuse of this type, i.e., to utilize no potential energy to eliminate an ignition chain locking device. The spring is completely relaxed in the safety position of the system and is energized only when an associated recoil bolt undergoes axial motion.

BRIEF DESCRIPTION OF THE DRAWING

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
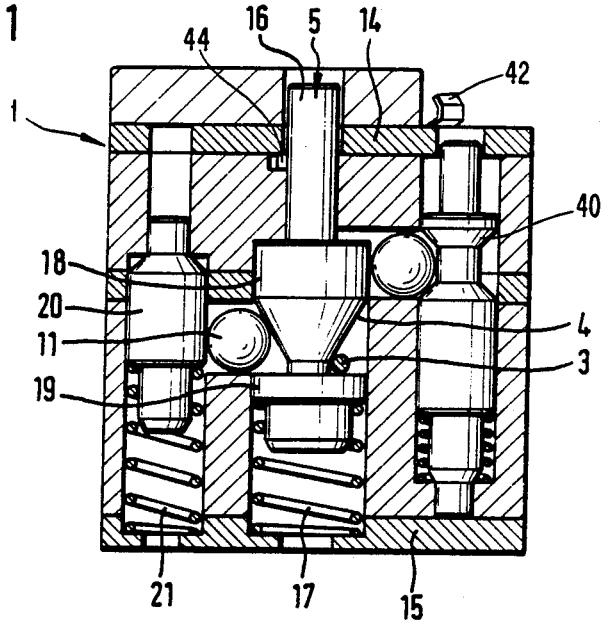
FIG. 1 is a longitudinal sectional view of a recoil bolt system taken along line 1—1 in the fuse housing.
Figure 2:
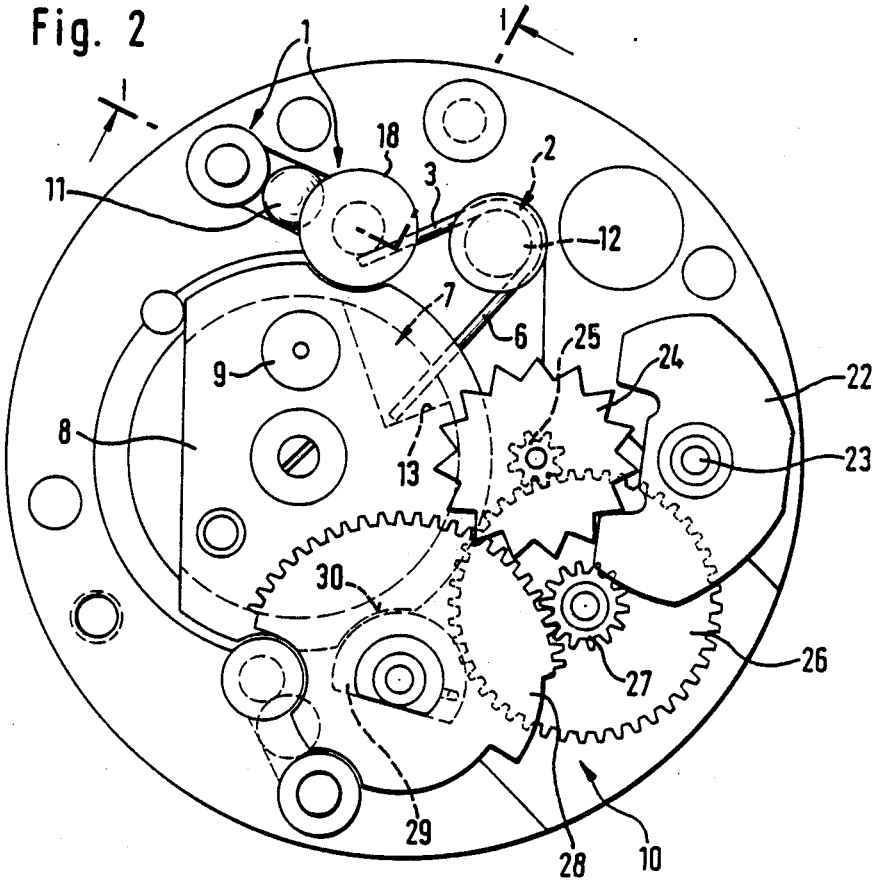
FIG. 2 is a schematic plan view of the fuse.

A recoil bolt system 1 is located between two fixedly spaced apart plates 14 and 15, as depicted in FIG. 1. This recoil bolt system comprises a first recoil bolt 5 having a front shaft 16 set slidably into the front plate 14 and a rear end resting axially against a spring 17 supported on the rear plate 15. The recoil bolt 5 further comprises an intermediate cone 4 located between front and rear shoulders 18, 19. Disposed parallel to the recoil bolt 5 is a second recoil bolt 20, which has a front end set into the housing and a rear end resting axially against a spring 21 supported on the rear plate 15.

The two recoil bolts 5 and 20 are operably coupled together by means of a ball 11 as will be later explained. A leg spring 2, bent in the shape of a U around a bolt 12, is set into the housing, with the end of a first spring leg 3 thereof resting against the lower part of the cone 4 of the recoil bolt 5. The second spring leg 6 of the spring is resting in a recess 7 of the outer periphery of movable detonator carrier such as a rotatable rotor 8. The spring leg 6 is supported in particular against a shorter wall 13 of the recess, located on a radius of the rotor 8. The rotor 8 is further equipped with a conventional live position lock 9 and is drivingly connected with a conventional blocking device 10 which is described in detail below. Briefly, the blocking device 10 includes a conventional escapement mechanism which controls the rate of rotation of the rotor when the latter is unlocked for rotation upon the firing of the projectile.

In the safety position of the fuse, the leg spring 2 is unstressed and is protected against unintentional stressing by the securing of the recoil bolt system 1. Accordingly, no spring force is applied to the rotor 8. This satisfies the requirement that no potential energy be used to eliminate the ignition chain blocking system.

In response to axial acceleration of the fuse upon the firing of the projectile, the recoil bolt system 1 is released. That is, the second bolt 20 is displaced axially rearwardly, enabling the ball 11 to be displaced to the left in FIG. 1 under the action of the rearwardly urged first bolt 5. The camming cone 4 of the rearwardly traveling first bolt 5 then stresses the leg 3 of the U-shaped leg spring 2. The rotor is thus biased for rotation by the spring, but is temporarily secured by the locking mechanism 10. The bolt 5 is locked in its retracted position by means of a spring 44 which snaps across the front end thereof. In response to the firing recoil, the blocking mechanism is unlocked for movement by conventional means not forming part of the present invention, i.e., by a separate recoil bolt unit.

The blocking device 10 comprises an oscillating anchor 22 located rotatingly on a shaft 23 and engaging a star wheel 34 to define therewith a spring-driven escapement mechanism. A pinion 25 mounted fixedly on the shaft of the star wheel 24 meshes with an intermediate gear 26 which is mounted on the same shaft as a second pinion 27. The pinion 27 meshes with a toothed segment 28, whereby a disk 29, mounted fixedly on the shaft of the toothed segment, performs a limited rotation. When no portion of the circular periphery of the disk 29 remains disposed in the recess 30 of the rotor, the rotor 8 is released from the blocking device 10, and subsequently pivots into its live position, under the urging of the spring leg 6.

The bolt 40 shown to the right of the bolt 5 in FIG. 1 is employed for the actuation of a conventional battery contact 42 and has no bearing on the present invention.

It will be appreciated that the fuse according to the present invention provides a higher degree of safety, as no prestressed spring is present to bias the rotor toward a live position prior to a firing of the projectile.

Although the present invention has been described in connection wirh a preferred embodiment of the invention, it will be appreciated by those skilled in the art that additions, substitutions, deletions, and modifications not specifically described may be made without departing from the spirit and scope of the invention, as defined in the appended claims.

What is claimed is:

1. A fuse for low spin or non-spin projectiles comprising:

a detonator carrier movable to a live position, blocking means for normally preventing movement of said detonator carrier to said live position and being releasable in response to firing recoil to permit movement of said detonator carrier to said live position, spring means operably connected to said detonator carrier and disposed in a relaxed state prior to firing recoil, and spring-energizing recoil means operable connected to said spring means for energizing said spring means in response to firing recoil to bias said detonator carrier toward said live position, said spring-energizing recoil means comprising a recoil member arranged for movement in response to firing recoil, said recoil member including cam means arranged to displace one portion of said spring means for imparting a bias to another portion of said spring means which bears against said movable detonator carrier.

2. A fuse according to claim 1, wherein said spring means comprises a generally U-shaped member defined by first and second legs which comprise said first and second portions, respectively.

3. A fuse according to claim 2, wherein said detonator carrier comprises a rotatable rotor, said rotor including a recess in its outer peripheral surface, said recess including a long wall and a short wall, said short wall oriented radially relative an axis of rotation of said rotor, said second leg bearing against said short wall.

4. A fuse according to claim 3, wherein said second leg of said spring means engages said detonator carrier, said spring-energizing means comprising a pair of recoil bolts disposed side-by-side and a ball operatively disposed between said recoil bolts, each of said bolts being arranged for axial sliding movement in response to firing recoil, one of said bolts containing a cam surface engaged and blocked by said ball, said bolts being axially slidable in response to firing recoil to enable said cam to displace said ball out of blocking position, said first leg of said spring being positioned for engagement by said cam surface so as to be displaced thereby in a manner stressing said second leg to bias said detonator carrier toward a live position.

5. A fuse for low spin or non-spin projectiles comprising:

a detonator carrier movable to a live position, blocking means for normally preventing movement of said detonator carrier to said live position and being releasable in response to firing recoil to permit movement of said detonator carrier to said live position, spring means operably connected to said detonator carrier and disposed in a relaxed state prior to firing recoil, and spring-energizing recoil means operable connected to said spring means for energizing said spring means in response to firing recoil to bias said detonator carrier toward said live position, said spring means comprising first and second legs, said second leg engaging said detonator carrier, said spring-energizing means comprising a pair of recoil bolts disposed side-by-side and a ball operatively disposed between said recoil bolts, each of said bolts being arranged for axial sliding movement in response to firing recoil, one of said bolts containing a cam surface engaged and blocked by said ball, said bolts being axially slidable in response to firing recoil to enable said cam to displace said ball out of blocking position, said first leg of said spring being positioned for engagement by said cam surface so as to be displaced thereby in a manner stressing said second leg to bias said detonator carrier toward a live position.

* * * * *